United States Patent [19]

Ortiz Bordallo

[11] Patent Number: 4,945,696

[45] Date of Patent: Aug. 7, 1990

[54] FLOORING AND/OR TILING

[76] Inventor: Antonio J. Ortiz Bordallo, Magallanes, 1, Madrid, Spain

[21] Appl. No.: 337,883

[22] Filed: Apr. 14, 1989

[51] Int. Cl.[5] ..... E04C 1/00

[52] U.S. Cl. ..... 52/311; 273/157 R; 434/96; D25/161

[58] Field of Search ..... 52/311; 273/157; 434/96; D25/161

[56] References Cited

U.S. PATENT DOCUMENTS

| | | | |
|---|---|---|---|
| D. 199,970 | 1/1965 | Goodrich | D25/161 |
| D. 249,966 | 10/1978 | Marquis | D25/161 |
| 4,537,001 | 8/1985 | Uppstrom | 52/311 |

FOREIGN PATENT DOCUMENTS

| | | | |
|---|---|---|---|
| 8118999 | 4/1983 | France | 434/96 |

OTHER PUBLICATIONS

Grunbaum, Branko and Shephard, G. C., *Tilings and Patterns,* W. H. Freeman and Company, N.Y., 1987, pp. 519–580.

*Primary Examiner*—David A. Scherbel
*Assistant Examiner*—Lan Mai
*Attorney, Agent, or Firm*—Wenderoth, Lind & Ponack

[57] ABSTRACT

Flooring and/or tiling having golden arabesque designs are made up primarily of three pieces. First, there is a square whose sides will have common "a" measurements. Secondly, there is a rectangle whose larger side will measure "a" long and whose shorter side will be "$a\sqrt{2}-a$", obtained as the difference between the diagonal of the square having "a" sides and the proper "a" side. The third piece is a rectangle whose larger side will be "a" long and whose lower side will be $$\text{“}\frac{a(3-2\sqrt{2})}{2}\text{”}$$

obtained as the difference between the half of the square "2" and the lesser side of the second rectangle "$a\sqrt{2}-a$," "a" being any real number. The first piece or square has its diagonal line marked while the second piece, or principal rectangular piece, has an arc with a radius of "$a\sqrt{2}$" drawn from vertex to vertex.

6 Claims, 2 Drawing Sheets

FLOORING AND/OR TILING

BACKGROUND OF THE INVENTION

The present invention relates to flooring and tiling with golden arabesque designs which, by its conception as well as its practicality, contributes to many important advantages in the field of construction. Because of its nature it can be used in soldering as well as tiling, siliceous clay types, landscapes, woods, slate, etc., with drawings and perimeters to be treated on the bases of the same colors or of different colors from the general color of a piece.

Today, in reference to the status of previous techniques, there is no type of floor, pavement, or tiles which are similar to the present invention. At present, painting tiles in various colors is the only recourse for providing flooring or tiling with golden arabesque designs. Various types of contrasting materials are also used.

SUMMARY OF THE INVENTION

The present invention provides golden ornamented flooring, which is the same as the drawing used in flooring or the painting of tiling in an arabesque style, made by a rectangular golden division which is formed by the side of any square or its diagonal.

The flooring according to the present invention is formed by three basic pieces. The first piece is a square whose sides have the same "a" dimension. "a" may be any real number. Secondly, there is a rectangular piece whose sides are such that the longer side has the same length as that of the first square piece, that is to say "a," while the lesser side will have a "$a(\sqrt{2}-a)$" length referred to as "L". This distance is produced from the difference between the diagonal of the square having "a" sides and one of its corresponding sides. The third piece is another rectangle whose major side has the same "a" length, while its shorter side has the dimensions $$\text{“}\frac{a(3-2\sqrt{2})}{2}\text{”},$$

a distance which is equal to the difference between half of the side of the square, $$\text{“}\frac{a}{2}\text{”},$$

and that of the short side of the second rectangle "$a(\sqrt{2}-1)$."

Once the measurements of the three pieces which make up the golden flooring have been defined, we shall proceed to explain in more detail what these pieces are made of.

In the first place, the first piece is a square whose sides measure "a", "a" being equal to any real number. In its interior surface one of its diagonal lines is drawn, which measures "$a\sqrt{2}$."

The second piece will be a rectangle having a long side measuring "a" and a short side measuring "$a(\sqrt{2}-1)$", "a" being any real number. On this rectangle is drawn a circumferential arc whose radius is "$1\sqrt{2}$". In other words, the diagonal of a square whose side is "a" is the radius of the arc, the arc going from one vertex of the second rectangle to its opposite vertex.

The third piece will also be a rectangle, whose long side is "a" in length, "a" being any real number, while its short side is $$\text{“}\frac{a(3-2\sqrt{2})}{2}\text{”}$$

in length. This one has no drawing.

BRIEF DESCRIPTION OF THE DRAWINGS

Further objects, features and advantages of the present invention will become apparent from the following detailed description of the invention, taken in conjunction with the accompanying drawings, wherein.

DETAILED DESCRIPTION OF THE PREFERRED EMBODIMENT

Figure 1:
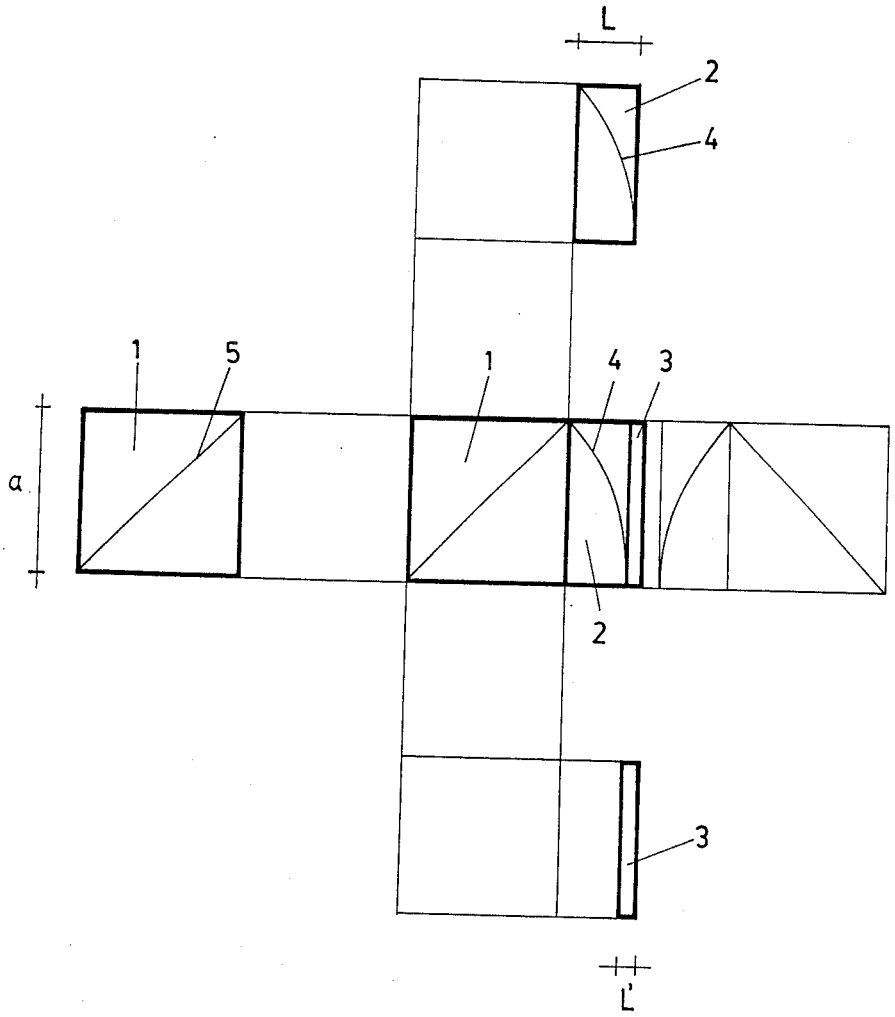
FIG. 1 illustrates a configuration of three flooring and tiling pieces according to the present invention.

FIG. 1 illustrates a configuration of three flooring or tiling pieces, constituting the object of the invention. A first piece is a square 1 whose sides have a magnitude of "a," where "a" is any whole number. Second and third pieces 2 and 3 are developed and obtained from square 1, wherein the magnitude of the diagonal of square 1, which measures "$a\sqrt{2}$", is transferred to its base side to develop an arc 4, as illustrated at the central portion of FIG. 1. The second FIG. 2 will thus be constituted by a rectangle whose long side has the same magnitude as that of the square, "a," and whose short side is the difference between the diagonal of the square and the magnitude of the side "a", i.e. "$a\sqrt{2}-a=a(\sqrt{2}-1)$", labelled as magnitude "L".

Piece 3 is a rectangle whose long side will have an identical magnitude to the side of the "a" square, while its short side is obtained as the difference between half of the side "a" of the square and the short side of the second piece, its value being expressed numerically as $$\text{“}\frac{a}{2}-a(\sqrt{2}-1)=\frac{a(3-2\sqrt{2})}{2}\text{”},$$

"a" equalling, as has been mentioned before, any real number. This magnitude is labelled "L'".

The drawings which these pieces show as part of the invention is as follows:

Piece 1, or the square whose sides are of magnitude "a," shall include a drawing of one of its diagonals 5, whose magnitude, as has been mentioned, is "$a\sqrt{2}$."

Piece 2, or the rectangle with a long side of magnitude "a" and a short side of magnitude "$a(\sqrt{2}-1)$, will have as a drawing the circumferential arc 4 extending between two of its extreme vertexes.

Piece 3 will not have a drawing.

Figure 2:
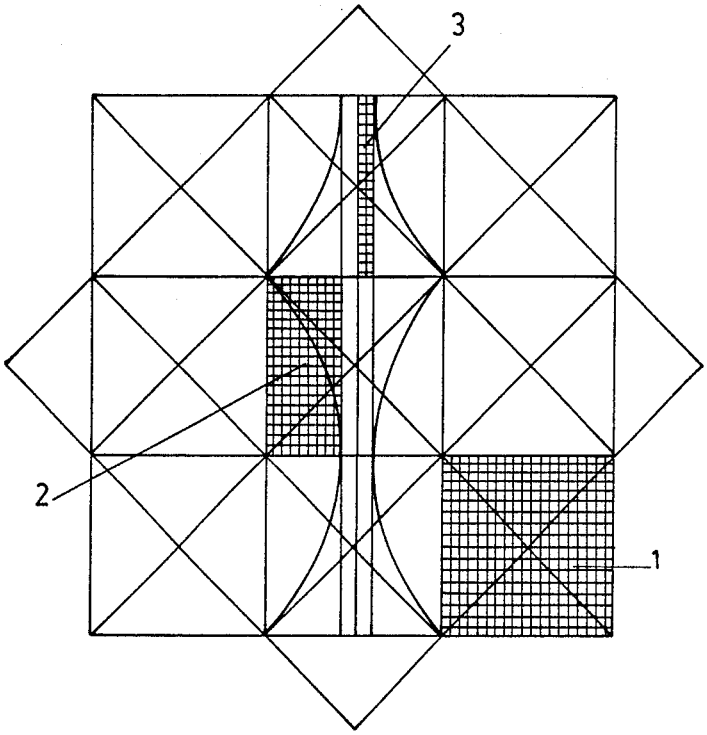
FIG. 2 illustrates an optional arrangement according to the invention by using the three pieces of FIG. 1.

FIG. 2 represents an optional arrangement from many arrangements which can be made with the present invention. The three pieces 1, 2 and 3 will be brought out by a dark interior. No other drawings are given as examples, due to the innumerable combinations which can be made with the three pieces of the invention.

This invention may cover for its realization any type of material, be it for flooring and/or tiling, sandstone types, landscapes, woods, slate, etc., with drawings and perimeters of a different color from the basic color of the piece. This color may be any color within the gamut of the spectrum, which may be different or the same as the general color of the piece or the cleft made on the piece or of a different color than the general color of the piece, or any other type of treatment which describes the above discussed geometry.

Any color of the spectrum, or an industrial color, can be used. Any other known type of treatment is available as long as it is made of a flat or corrugated surface or any other surface in accordance with the above described invention.

Having presented the description of the invention, we contend that the following claims are declared to be new and original:

1. A tiling arrangement having golden arabesque designs comprises a plurality of tiling pieces, said plurality of tiling pieces comprising:

a first tiling piece shaped in the form of a square, said square having sides of an arbitrary magnitude 'a';

a second tiling piece shaped in the form of a rectangle, the longer sides of said rectangle having a magnitude 'a' and the short sides of said rectangle having a magnitude '$a(\sqrt{2}-1)$'; and a third tiling piece shaped in the form of a rectangle, the longer sides of said rectangle of said third tiling piece having a magnitude 'a' and the shorter sides of said rectangle having a magnitude $$\text{'}\frac{a(3-2\sqrt{2})}{2}\text{'},$$

2. The tiling arrangement as set forth in claim 1, wherein:

said first tiling piece has a diagonal of said square drawn thereon.

3. The tiling arrangement as set forth in claim 2, wherein:

said second tiling piece has an arc drawn thereon, said arc having a radius of a magnitude '$a\sqrt{2}$', and said arc extending between two opposite vertexes of said rectangle of said second tiling piece.

4. The tiling arrangement as set forth in claim 1, wherein:

said second tiling piece has an arc drawn thereon, said arc having a radius of a magnitude '$a\sqrt{2}$', and said arc extending between two opposite vertexes of said rectangle of said second tiling piece.

5. The tiling arrangement as set forth in claim 1, wherein:

said short sides of said rectangle of said second tiling piece are equal in magnitude to the difference between the magnitude of a diagonal of said square of said first tiling piece, '$a\sqrt{2}$', and the magnitude of one of the sides of sides said square 'a'.

6. The tiling arrangement as set forth in claim 1, wherein:

said short sides of said rectangle of said third tiling piece are equal in magnitude to the difference between the magnitude of half of one side of said square of said first tiling piece, $$\text{'}\frac{a}{2}\text{'},$$

and the magnitude of said short sides of said rectangle of said second tiling piece, '$a(\sqrt{2}-1)$'.

* * * * *